US005635026A

United States Patent [19]

Kettunen et al.

[11] Patent Number: 5,635,026

[45] Date of Patent: Jun. 3, 1997

[54] COOKING CELLULOSE MATERIAL WITH HIGH ALKALI CONCENTRATIONS AND/OR HIGH PH

[75] Inventors: Auvo K. Kettunen, Neuvoton; Kaj O. Henricson, Helsinki; Aki H. Vilpponen, Karhula, all of Finland; Jian E. Jiang, Queensbury; Bruno S. Marcoccia, South Glens Falls, both of N.Y.

[73] Assignee: Ahlstrom Machinery Inc., Glens Falls, N.Y.

[21] Appl. No.: 558,138

[22] Filed: Nov. 13, 1995

[51] Int. Cl.[6] ..... D21C 3/26

[52] U.S. Cl. ..... 162/19; 162/29; 162/33; 162/38; 162/39; 162/42; 162/47

[58] Field of Search ..... 162/19, 29, 30.11, 162/33, 34, 38, 39, 42, 45, 46, 47, 52, 68, 17

[56] References Cited

U.S. PATENT DOCUMENTS

| | | | |
|---|---|---|---|
| 5,138,535 | 8/1992 | Tikka | 162/19 |
| 5,575,890 | 11/1996 | Prough et al. | 162/19 |

FOREIGN PATENT DOCUMENTS

| | | |
|---|---|---|
| 0477059A2 | 3/1992 | European Pat. Off. . |
| WO95/18261 | 7/1995 | WIPO . |
| WO96/02698 | 2/1996 | WIPO . |

OTHER PUBLICATIONS

"Modified continuous kraft pulping—now a reality", Johansson et al Svensk Papperstidning, nr 10, 1984, pp. 30–35.

"Extended delignification in kraft cooking through improved selectivity", Sjoblom et al, Paperi Ja Puu—Paper and Timber, No. 4, 1983, pp. 227–240.

"Improved modified kraft cooking—Part 1. Pretreatment with a sodium sulfide solution", Mao et al, Paperi Ja Puu—Paper and Timber, vol. 74, No. 6, 1992, pp. 491–494.

"Extended delignification in kraft cooking through improved selectivity—Part II. The Effects of Dissolved Lignin", Sjöblom et al, Paperi Ja Puu—Paper and Timber, vol. 70, No. 5, 1988, pp. 452–460.

"Improved modified kraft cooking—Part 3: Modified vapor–phase polysulfide cooking", Mao et al, TAPPI Journal, vol. 77, No. 11, Nov. 1994, pp. 149–153.

"Improved modified kraft cooking—Part 4. Modified cooking with improved sulfide and lignin profiles", Mao et al, Paperi Ja Puu—Paper and Timber, vol. 77, No. 6–7, 1995, pp. 419–422.

"Modified Kraft Pulping—Fundamentals and Applications in Continuous Cooking" by Jiang, Manager, R&D Laboratory, Kamyr, Inc., Glens Falls, NY 12801, Beijing Seminar, 1994 Aug. 29,

*Primary Examiner*—Donald E. Czaja
*Assistant Examiner*—Steven B. Leavitt
*Attorney, Agent, or Firm*—Nixon & Vanderhye P.C.

[57] ABSTRACT

Chemical (typically kraft) pulp having enhanced intrinsic fiber strength and bleachability compared to pulp produced using conventional or modified kraft cooking is produced by using high alkali and/or pH cooking. After being impregnated with a first cooking liquor (e.g. white liquor) having low effective alkali, the first liquor is extracted from the pulp, and it is impregnated with a second cooking liquor having an effective alkali concentration of at least 25 g/l and cooked at cooking temperature (e.g. 140°–190° C.) to produce a spent second cooking liquor having a residual effective alkali concentration of at least about 15 g/l, which is then extracted from the pulp. The spent second liquor may be used to preheat incoming white liquor, and then flashed and used as the first liquor. The pH of the first liquor is typically less than about 13.0, and the residual pH of the spent second liquor is about 13.0 or more.

19 Claims, 6 Drawing Sheets

FIG. 8
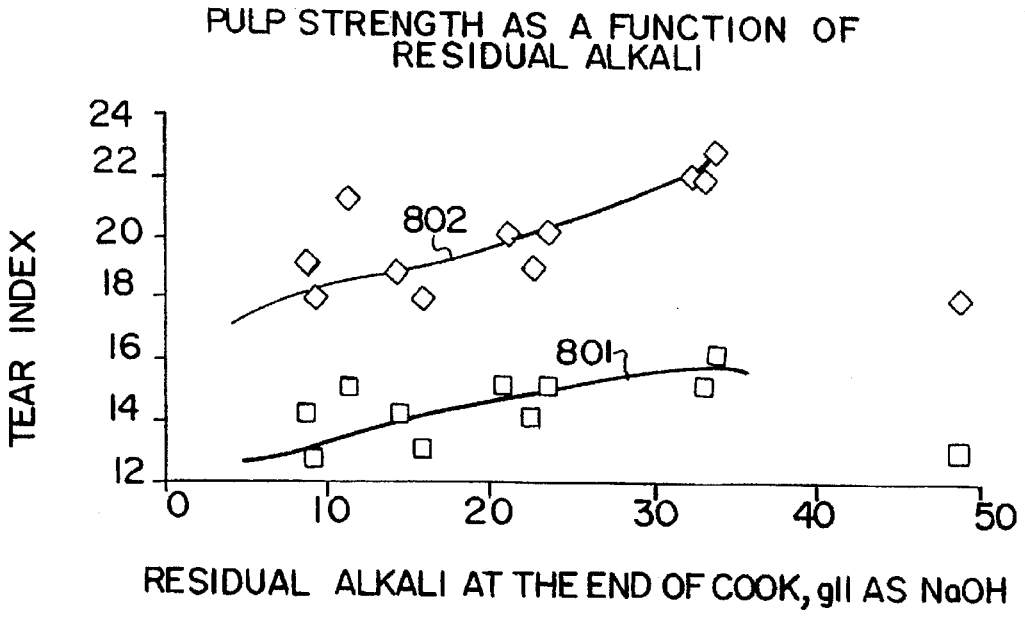
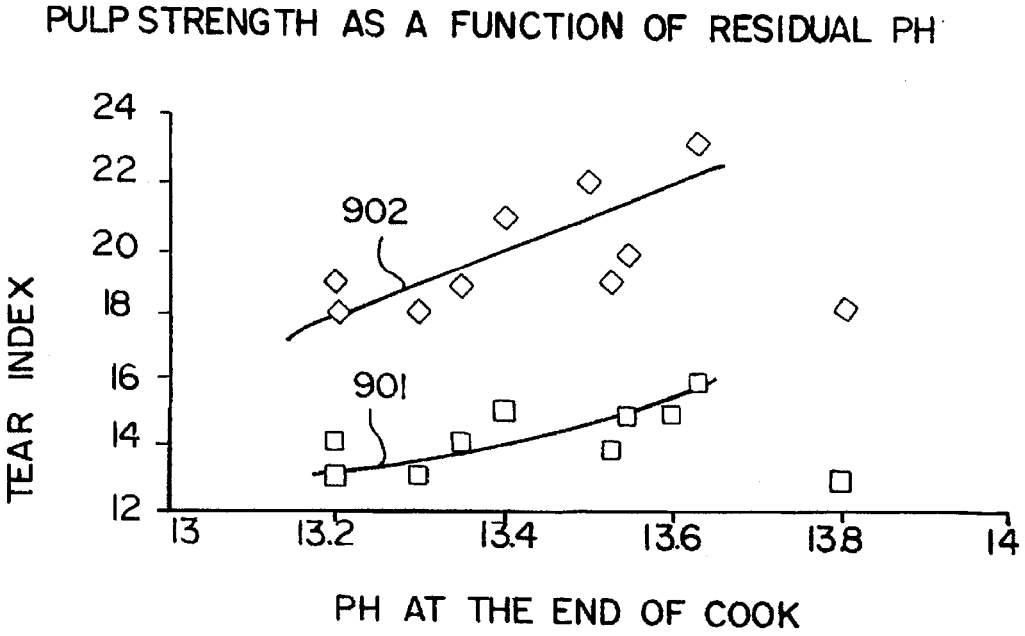
FIG. 9

COOKING CELLULOSE MATERIAL WITH HIGH ALKALI CONCENTRATIONS AND/OR HIGH PH

BACKGROUND AND SUMMARY OF THE INVENTION

The two most important active cooking chemicals used to treat comminuted cellulosic fibrous material during the sulfate or "kraft" cooking process are sodium sulfide, $Na_2S$, and sodium hydroxide, NaOH. An expression used in the pulping industry to designate the amount of cooking chemical present during pulping is "effective alkali". Since sodium sulfide hydrolyzes in an aqueous medium to form sodium hydroxide, or "alkali", and sodium hydrosulfide, "effective alkali" is defined as the total of the concentration of sodium hydroxide plus one-half the concentration of sodium sulfide (expressed as NaOH), or $$\text{effective alkali}=[NaOH]+\tfrac{1}{2}[Na_2S]$$

Various methods of treating cellulose material with alkali have been presented. For example, in conventional kraft cooking, all the cooking chemicals, or effective alkali, are introduced at the beginning of the cooking process, that is before the impregnation phase. In this process the alkali is gradually consumed as the treatment progresses. Typically, the effective alkali in the cooking liquor for a conventional kraft cook is greatest at the beginning of the cook and the least at the end of the cook.

Following studies performed at the Swedish Forest Products Research Institute, STFI, in the early 1980s, so-called "modified cooking" was introduced in the early-to-mid 1980s. As described by Sjoblom, et al. [Paper and Timber, 1983, No.4, page 227], one of the goals of this type of cooking was to provide a "low and uniform concentration of effective alkali" as a means to improve both viscosity and yield. The variation or profile of the concentration of effective alkali throughout a modified continuous kraft cook was illustrated and contrasted with the variation for conventional kraft cook by Johansson, et al. in 1984 [Svensk Papperstidning, No. 10]. Johansson, et al. described how such modified cooking with more uniform alkali concentrations produced improved pulp viscosity, better bleachability and lower environmental load, among other things. This work and subsequent trials by others established that a low and uniform effective alkali distribution in both continuous and batch kraft cooking was the preferred mode of operation. This low and uniform treatment of pulp became the cornerstone of the MCC® and EMCC® digesters and cooking processes, as sold by Ahlstrom Kamyr of Glens Falls, N.Y., which became very popular in the industry in the late 1980s and early 1990s.

Though the benefits of a low and uniform effective alkali on pulp viscosity and yield have been accepted in the industry, it has been surprisingly discovered that such profiles do not produce pulp having the highest intrinsic fiber strength.

The term "pulp viscosity" had been associated directly with pulp fiber strength. A pulp's viscosity is sometimes interpreted as an indirect measure of the a pulp's relative fiber damage, or depolymerization. The lower the viscosity, according to this reasoning, the more the fiber is damaged. It has often been assumed that a damaged fiber produced a weaker pulp and hence reduced viscosity was interpreted as reduced intrinsic fiber strength. However, it has been found according to the present invention that high effective alkali concentrations and/or high pH during bulk and residual delignification, though possibly reducing a pulp's viscosity, produce a pulp having higher intrinsic fiber strength. For instance, laboratory cooks using high alkali concentrations during cooking, for example with effective alkali concentrations of 32 g/l required only about 40% of the H-factor as is conventional to produce a kappa number of 21 for softwood and increased pulp strength. Also, cooking in high effective alkali and/or pH gives pulp with better bleachability (as recognized in the literature). Furthermore, the high effective alkali concentration yields a high residual alkali concentration in the spent cooking liquor which can be effectively used to pretreat chips prior to the bulk delignification stage of cooking. The present invention permits the use of lower cooking temperatures and/or shorter cooking times to effect cooks comparable to conventional methods. In other words, by using this invention cooking vessels can be designed smaller and cheaper. This also means that existing cooking vessels, which are limited due to the existing processes, can be made to produce more pulp per unit time without increasing their temperature or effective alkali charge.

The terms "bulk" and "residual", as applied to delignification, are standard concepts in the pulp and paper art, and are defined in "Pulp and Paper Manufacturing", Volume 5, Alkaline Pulping, Grace et al, Technical Section, Canadian Pulp & Paper Association, 1989, pages 60–62. In brief, "bulk delignification" is that phase of delignification during which most of the lignin is removed with a selectivity that is high compared to that during the initial phase that it follows, while "residual delignification" is a phase after bulk delignification characterized by a much slower delignification rate, increased yield loss, and increased alkali consumption per unit of lignin removed.

According to the present invention the exact mechanism that achieves desired results is not completely understood. High pH—which is not identical to high alkali (and may be a more accurate indicator of active cooking chemicals), although high alkali normally creates a condition of high pH—may be more significant than high alkali itself, and the combination of the two may be most significant.

The broadest aspect of this invention comprises a method of cooking comminuted cellulosic fibrous material employing high effective alkali concentrations in at least one stage of treatment. This high alkali concentration is preferably practiced in the bulk delignification stage of cooking. Preferably, this effective alkali concentration exceeds 15 g/l (more preferably 20 g/l) during both bulk and residual delignification. The method of the invention may be performed continuously or in batch mode, in a single-vessel or multiple-vessel system, in a hydraulic or vapor/liquor-phase digester; in the preferred embodiment, however, the method of the invention is performed continuously, using conventional continuous digesters of a variety of types.

According to one aspect of the present invention, a method of treating comminuted cellulosic fibrous material to produce cellulose chemical pulp with enhanced intrinsic fiber strength compared to pulp produced by convention or modified cooking methods, is provided. The method comprises the steps of continuously and sequentially: (a) Treating (e.g. impregnating) the comminuted cellulosic fibrous material with a first cooking liquor having a first effective alkali concentration which is greater than 10 g/l. (b) Further treating the (e.g. now impregnated) material with the first cooking liquor so as to consume alkali from the first cooking liquor, so that the effective alkali concentration of the spent first liquor is reduced to about 10 g/l or less. (c) Extracting the spent first cooking liquor from the material. (d) Treating (e.g. impregnating) the material with a second cooking liquor having a second effective alkali concentration greater than 25 g/l and greater than the first concentration, and a pH of at least 13, the second cooking liquor providing at least 50% of the total alkali to be consumed by the material in the production of chemical pulp. (e) Cooking the material with the second cooking liquor at cooking temperature to produce chemical pulp and a spent second cooking liquor having an effective alkali concentration of greater than about 15 g/l (e.g. greater than about 20 g/l). And (f) extracting the spent second cooking liquor from the pulp.

Step (b) is preferably practiced using as the first cooking liquor the spent second cooking liquor from step (f); some additional cooking liquor (typically white liquor) may be added. In typical existing prior art pulping systems, "conventional" or "modified," the cellulose material must be treated with cooking chemicals to pretreat or impregnate the material prior to formal cooking or bulk delignification. Normally, more than about 25%, sometimes more than 50%, of the total alkali consumed in the production of pulp is consumed during this pretreatment, that is, in step (b). However, among other advantages, the present invention obviates the need to introduce fresh cooking chemical in this pretreatment stage by using the residual alkali present in the black liquor produced in a high-alkali cooking process as the source of cooking chemical in this stage.

The second cooking liquor preferably is white liquor combined with wash liquor, or black liquor, and desirably more than about 80% of the total amount of white liquor (total alkali to be consumed) to be used to produce the pulp should be added in step (d) as the second cooking liquor. Wash liquor is used to dilute the white liquor for the second cooking liquor to provide a desired effective alkali concentration, and a favorable liquor to wood ratio. The practice of step (d) may also inherently result in the heating of the material to cooking temperature, or heating may be practiced separately, cooking temperature typically being in the range of 140°–180° C., typically between 150° and 170° C. Preferably, the liquor present in the digester as the second cooking liquor has an effective alkali of greater than about 25 g/l, e.g. about 25–60 g/l, typically about 30–50 g/l. These ranges of effective alkali concentration are typically provided by diluting the fresh cooking chemically, initially at about 90 g/l or more effective alkali, with any available source of dilution. This dilution may include black liquor, wash filtrate or cold blow filtrate, among others. The invention also includes the subsequent steps of cooling and washing the pulp, and prior to step (a) the material is preferably steamed to heat it and remove air from it. Also, steps (a), (b), (d) and (e) may be practiced either co-currently or counter-currently (flow of material to the flow of cooking liquor). The spent liquors extracted in steps (c) and (f) should be kept separately, and used for different purposes, typically the liquor from step (f) being used to preheat the second cooking liquor, and then flashed, with the remaining liquor used as the first cooking liquor while the steam is fed to the chips bin or presteaming vessel for pretreatment of the material, and the liquor from step (c) passed to conventional recovery in a kraft mill.

The invention also relates to a method of producing chemical pulp having enhanced intrinsic fiber strength from comminuted cellulosic fibrous material, comprising the steps of continuously and sequentially: (a) Treating (e.g. impregnating) the comminuted cellulosic fibrous material with a first cooking liquor having a first pH which is more than about 13.0 (e.g. more than about 13.2). (b) Further treating the (impregnated) material with the first cooking liquor so as to consume alkali from the first cooking liquor, so that the residual pH of the first cooking liquor is about 13.0 or less (or about 13.2 or less). (c) Extracting the spent first cooking liquor from the material. (d) Treating (e.g. impregnating0 the material with a second cooking liquor having a second pH of about 13.5 or greater (e.g. about 13.7 or greater) and greater than the first pH, the second cooking liquor providing at least 50% of the total alkali to be consumed by the material in the production of chemical pulp. (e) Cooking the material with the second cooking liquor at cooking temperature to produce chemical pulp and a spent second cooking liquor having a residual pH of at least about 13.0 (e.g. about 13.4 or greater or about 13.6 or greater); and (f) extracting the spent second cooking liquor from the pulp.

The invention also relates to a kraft pulp with enhanced intrinsic fiber strength and bleachability compared to kraft pulp produced by conventional and modified cooking. The kraft pulp according to the invention is produced using one or both of the methods as described above.

It is the primary object of the present invention to provide enhanced intrinsic fiber strength and enhanced bleachability chemical pulp by cooking with high alkali concentration and/or pH. This and other objects of the invention will become clear from an inspection of the detailed description of the invention, and from the appended claims.

BRIEF DESCRIPTION OF DRAWINGS

FIG. 8 is a graphical representation of pulp strength as a function of residual alkali at two different tensiles; and FIG. 9 is a graphical representation of pulp strength as a function of residual pH at two different tensiles.

DETAILED DESCRIPTION OF THE DRAWINGS

Figure 1:
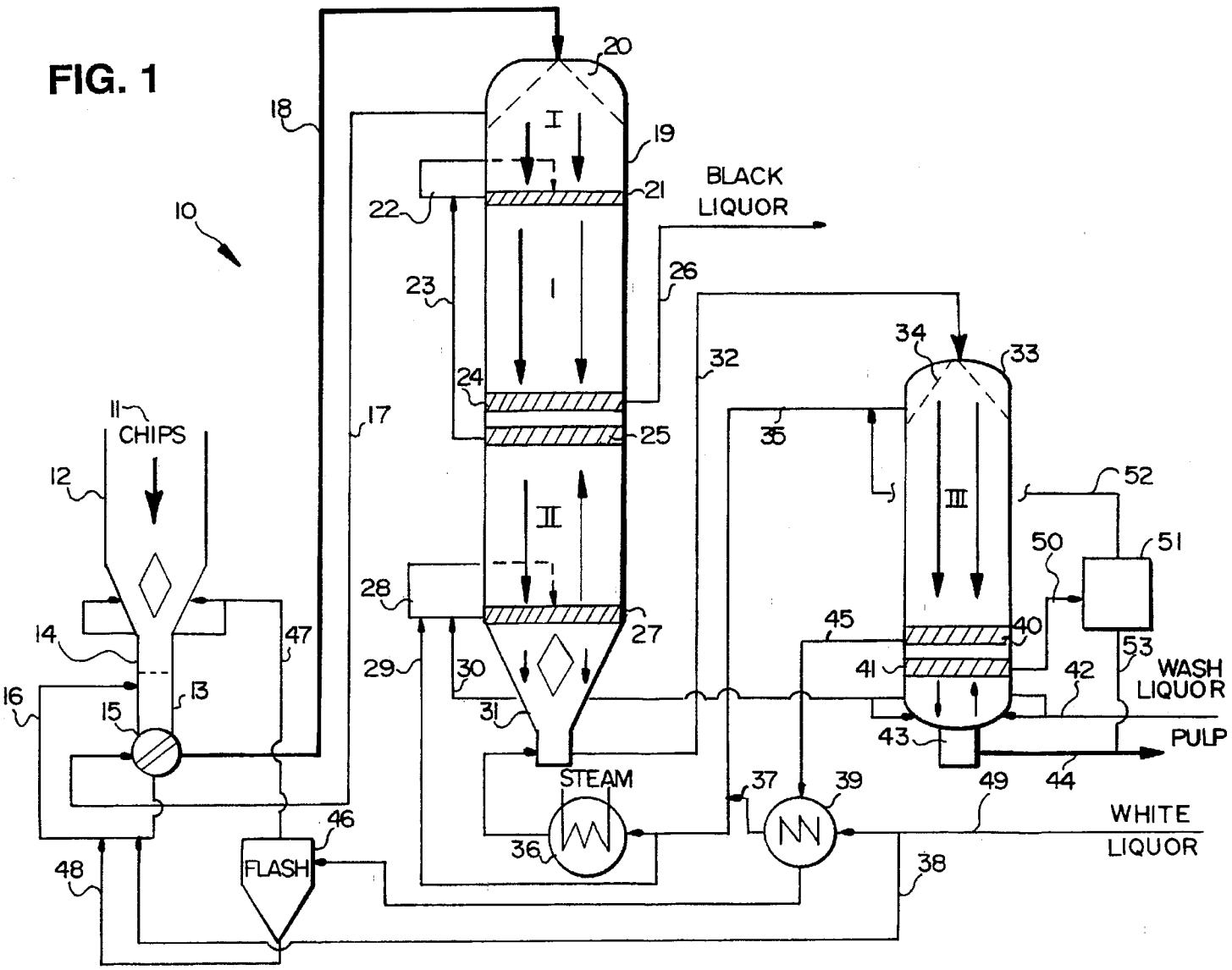
FIG. 1 is a schematic representation of a first embodiment of equipment (new two-vessel digester system) for practicing a method for producing enhanced intrinsic fiber strength chemical pulp according to the present invention.

The disclosed invention can be practiced in conjunction with other preferred cooking methods to yield a pulping system which produces a pulp having the highest possible strength while making the most efficient use of the available energy, material and chemicals. Typical pulping systems are disclosed in the drawings.

One typical system that incorporates the benefits of the disclosed invention is shown in FIG. 1. This FIGURE illustrates a typical two-vessel, hydraulic continuous digester system 10 for implementing the process of the invention. Wood chips 11, or other comminuted cellulosic fibrous material, are delivered to a chip bin 12 for presteaming and/or pretreatment. Typically, the bin 12 is a vessel having single-convergence and side-relief as described in co-pending U.S. application Ser. No. 08/189,546 filed on Feb. 2, 1994 (10-926) and 08/354,005 filed on Dec. 5, 1994 (10-1020) and sold under the trademark DIAMONDBACK by Ahlstrom Kamyr of Glens Falls, N.Y. The steaming process may be performed at atmospheric or superatmospheric pressure. The chips may be introduced to the bin by means of gates as shown in U.S. Pat. No. 4,927,312 or by synchronized gates as shown in pending application Ser. No. 08/350,129 filed on Nov. 11, 1994(10-1019).

The steamed chips are discharged from the chip bin into a conduit or chute 13 having a level of cooking liquor 14 such that the chips are immersed in cooking liquor and the process of cooking liquor impregnation begins. The discharge from the bin may include a rotary air-lock type feeder (not shown) such as a Chip Meter as sold by Ahlstrom Kamyr. The liquor level within the conduit 13 is maintained by conventional level control means (not shown). If desired, the liquid level may be maintained in the chip bin 12 above the conduit or chute 13.

The conduit 13 discharges to a conventional high-pressure feeder 15, also sold by Ahlstrom Kamyr. The rotary, pocket-type feeder 15 in conjunction with a high pressure pump (not shown) pressurizes and transports the chip slurry from the low pressure of the feed system to the high pressure of the cooking vessel (e.g. vessel 19). For example, the pressure of the chip slurry may be raised from a pressure ranging form 0 to 30 psi (0–2 bar), to a pressure required for the delignification reaction of 45 to 200 psi (3–14 bar). This feeding system typically includes as conventional components a chip chute pump, in-line drainer, level tank, etc. (all not shown) associated with circulation 16, as is conventional. This pressurization and transport may also be effected by a slurry-type pump as disclosed in co-pending applications Ser. No. 08/267,171 filed on Jun. 16, 1994 (10-961) or Ser. No. 08/428,302 filed on Apr. 25, 1995 (10-1051). During this pressurization and transport the chip slurry is typically exposed to heated cooking liquor, at a temperature of 80° to 120° C., typically 90° to 110° C., by means of circulation 17.

This heated, pressurized transfer of chips and liquor passes the slurry by means of conduit 18 to a top of a cooking vessel 19, for example, an impregnation vessel, pretreatment vessel, or digester. FIG. 1 illustrates a typical impregnation vessel 19 that can be used for this invention. Excess liquor is removed from the slurry by means of screens 20 and returned via conduit 17 to be used to slurry material from the feeder 15. In vessel 19 the chip slurry is exposed to a relatively long, cool co-current impregnation in the zone identified as zone I. This long, cool impregnation is disclosed in co-pending application Ser. No. 08/460,723 filed on Jun. 2, 1995 (ref. 10-1070), the disclosure of which is included by reference herein. In this long, cool impregnation zone I; which begins when liquor is introduced in high-pressure feeder 15, the chip slurry is typically maintained at a temperature of 80° to 110° C., preferably 90° to 105° C. Though this treatment is shown as a co-current treatment in FIG. 1, it may also be a counter-current treatment.

The impregnation zone I may include a screen 21 and a circulation 22 to aid in the downward movement of chips and to distribute heat and chemicals more uniformly throughout the chip column. This circulation may be provided with a conventional liquor pump and indirect steam heater (not shown). This circulation may also be supplemented by the addition of black liquor, white liquor, or pulp enhancing ingredients, such as polysulfides and anthraquinones and their derivatives. In FIG. 1, this circulation is supplemented via conduit 23 by black liquor removed from a subsequent treatment zone.

After being treated in the impregnation zone, zone I, the slurry typically passes to a counter-current heating zone, zone II. The zones I, II are separated by one or more liquor extraction screens 24 and 25, which via vessel pressure or pumping, remove liquor from the impregnation zone and provide the motive force for drawing liquor up through the counter-current zone II. The withdrawn liquor may be used elsewhere in the cooking process, or may be directed to the liquor and heat recovery system. For example, as shown in FIG. 1, the cooler dilute black liquor withdrawn from the upper screen 24 may be sent to recovery via conduit 26. The hotter liquor withdrawn through screen 25, which may contain usable alkali and sulfide, can be passed via conduit 23 to circulation 22 to increase the alkali and sulfide and to improve temperature distribution in the upper part of zone I. Even if a single screen assembly is used, the liquor, though mixed, may be divided and used as desired.

The hot liquor in conduit 26 may also may be directed to an indirect heat exchanger as disclosed in copending application Ser. No. 08/420,730 filed on Apr. 10, 1995 (10-1054).

The liquor withdrawal via screen 24 effectively terminates the impregnation stage and also removes wood moisture and steam condensate which tend to dilute the concentration of cooking chemicals in the subsequent cooking zones. The entire impregnation stage, from the time the chips encounter liquor at greater than 80° C. to the removal of the cooler liquor by means of the extraction screens, may last from thirty minutes to seventy-two hours, but is typically one to six hours in duration, preferably, one to three hours.

In the counter-current heating and impregnation zone II, the down-flowing, impregnated chips are heated by means of hotter cooking liquor drawn upward by means of screens 24 and 25. This liquor is typically heated by means of circulation 28 to a temperature of 120° to 160° C., typically 130° to 150° C., preferably 135° to 145° C. This counter-current heating may last from about five minutes to six hours, but typically lasts one-half to three hours. This countercurrent stage is preferred, but other means of heating the slurry may be used, such as one or more co-current heating circulations (using indirect or direct heating methods), the application of external heat to the vessel or flows from the vessel, or the like. Similar to circulation 22, circulation 28 typically includes one or more screens 27, a pump and an indirect steam heater (not shown). The liquor in this circulation may be supplemented by the addition of heated liquor extracted from subsequent cooking stages. The liquor in this circulation may also be supplemented by the addition of cleaner filtrate, with or without the addition of cooking liquor, so that dissolved wood material is displaced from the cooking system. By doing so, this system also employs the Lo-Solids™ cooking digester and process, as sold by Ahlstrom Kamyr, which is disclosed in co-pending application Ser. No. 08/056,211 filed on May 4, 1993 (ref.: 10-846) and WO 94/25668. In the preferred embodiment shown in FIG. 1, both hot black liquor, from the transfer circulation between the two vessels, via conduit 29, and cold blow wash filtrate, via conduit 30, are added to this circulation.

After being heated in the lower part of the impregnation vessel 19, the heated, impregnated slurry is then discharged from the impregnation vessel, heated to cooking temperature and passed to a second cooking vessel, or digester 33. Though the impregnation vessel may utilize a conventional rotating discharge device, the discharge outlet 31 from the first vessel is preferably has geometry exhibiting single-convergence and side-relief in lieu of a rotating mechanical device. This type of outlet is described in copending application Ser. No. 08/401,503 filed on Mar. 10, 1995 (10-1050) and is sold under the trademark DIAMONDBACK by Ahlstrom Kamyr.

During the discharge from the impregnation vessel, the chip and liquor slurry is exposed to cooking liquor essentially at full cooking temperature, that is, at a temperature between 140° and 180° C., typically between 150° and 170° C. The hot liquor introduced via conduit 35 to the discharge of the vessel 19 "slurries" the material to the top of the digester 33. Excess liquor is then typically removed from the slurry by screen 34 and returned to the outlet 31 by conduit 35. This return liquor circulation 35 is typically heated by steam in a conventional indirect heat exchanger 36. Prior to being introduced to the heat exchanger 36 some of the liquor in this circulation may be removed and introduced to the liquor circulation 28 via conduit 29.

Cooking liquor, typically kraft white liquor, is preferably introduced to the material in circulation 35 by means of conduit 37 upstream of the heater 36. As is characteristic of this invention, preferably a large percentage of the cooking liquor added to this system is added via conduit 37 to circulation 35. Typically, at least 50% of the cooking liquor is added to circulation 35, preferably at least 80% (e.g. about 90%) is added to circulation 35. This produces a very high effective alkali concentration in the digester of greater than twenty five grams per liter, preferably grater than thirty five grams per liter. The balance of the liquor may be added to circulations 16 via conduit 38 or to circulations 22 or 28 in order to ensure a minimum alkali content in these circulations to prevent lignin condensation, acid hydrolysis, etc. The cooking liquor added via conduit 37 may be heated indirectly in a heat exchanger 39 by steam or with hot spent cooking liquor extracted from the digester, for example, from screen 40.

In order to achieve the desired high alkaline and high pH conditions according to the present invention, the cooking liquor (such as kraft white liquor) added via conduit 37 may have the following properties: a total alkali on wood ranging from about 15–25% (typically about 16–22%); an effective alkali concentration of about 90–130 g/l as NaOH (typically about 100–120 g/l), diluted to the desired ranges of about 25–60 g/l, preferably about 30–50 g/l, before practice of the invention; and a flow of about 2.0–5.0 cubic meters per bone-dry metric ton of pulp ($m^3$/BDMT), typically about 3.0–4.0 $m^3$/BDMT.

The heated slurry with cooking liquor, essentially at cooking temperature, is transferred under pressure from outlet 31 to the top of the vessel, or digester, 33 via conduit 32. Excess liquor is removed via screen assembly 34 in the inlet to the digester and is returned to the impregnation vessel outlet 31 via conduit 35 to slurry the chips. Typically, this returned liquor is steam heated in an indirect heat exchanger 36 prior to being introduced to outlet 31. This heated liquor may be introduced to a several nozzles in the outlet to facilitate uniform discharge of the slurry.

The now fully-impregnated chips, at cooking temperature, pass co-currently downward in the digester 33 in zone III, as the pulping reaction proceeds. Though this treatment is shown as being co-current, it may also be a counter-current treatment. This cooking reaction with high alkali concentration may last from one-half to six hours, but typically only lasts one to three hours. In the lower section of the digester, hot, waste, cooking liquor is removed from the now fully-cooked chips by means of one or more screen assemblies 40 and 41. Cooler wash filtrate from the downstream pulp washers (not shown) may be introduced to the bottom of the digester via one or more conduits 42 to terminate the pulping reaction and to reduce the temperature of the cooked chip slurry. Wash liquor in conduit 42 may also be added where needed to reduce the concentration of dissolved material in the cook, for example, to circulations 155, 135 or 17. The thus cooled cooked chips are then discharged from the digester via outlet 43 to conduit 44. The cooked pulp is then passed to storage or to subsequent processing such as brownstock washing and bleaching (not shown). If a single screen 40 is used the extracted liquor may be divided and then used as desired.

Again, though conventionally this discharge is aided by a rotating discharge device, discharge may also be accomplished without the aid of a rotating device but by using an outlet geometry exhibiting single-convergence and side-relief. Such an outlet is disclosed in pending application Ser. No. 08/529,411 filed Sep. 18, 1995 (ref. 10-1124).

As shown in the FIG. 1, preferably, the hot spent cooking liquor is extracted from the digester by means of an upper screen assembly 40 and conduit 45. Since a majority of the effective alkali was introduced to the inlet of the digester, this hot liquor will have a relatively high unused alkali, or "residual alkali", content. The alkali concentration of the liquor in conduit 45 will typically be at least fifteen (e.g. at least twenty) grams per liter and is preferably at least about twenty five grams per liter. The residual alkali content in conventional kraft cooking and modified kraft cooking is typically kept between about six-twelve grams per liter. This lower residual alkali is sought conventionally to ensure that sufficient alkali is present at the point of liquor extraction for a proper cook but at the same time to minimize the waste of alkali that is discharged to the recovery system. The relatively large residual alkali of the present invention results from the preferred high alkali charge introduced to the digester. However, this alkalinity of this "spent" liquor, though it is not totally spent since it still contains an appreciable alkali content, can advantageously be recirculated to pretreat the wood chips. Note further that the liquor removed via conduit 45 also contains a significant amount of sulfide, typically ten to thirty grams per liter, that is also advantageous to have during chip pretreatment or impregnation. The ratio of sulfide concentration and effective alkali concentration is higher than in white liquor; therefore the spent cooking liquor has a higher sulfide concentration and/or a higher "sulfidity" so that a higher sulfidity is achieved at the beginning of delignification, when the material is treated with the liquor from conduit 45, than is common in conventional and modified cooks.

The liquor in conduit 45, containing both alkali and sulfide, is preferably passed to circulation 16 of the feed system for use in pretreatment or impregnation of the incoming wood chips. Since the liquor in conduit 45 is typically at cooking temperature, that is 140°–180° C., it may be used as a heating medium in heat exchanger 39 to heat the incoming white liquor in conduit 49. This hot liquor may also be flashed in flash tank 46 to produce a source of steam and to further cool the liquor. The steam may be used via conduit 47 to presteam the chips in chip bin 12. The cooled liquor may be passed to circulation 16 via conduit 48. Instead of flashing, the hot liquor may also be used to indirectly heat water in a heat exchanger to produce a "clean" source of steam.

Also, a second lower screen assembly 41 can be used in the bottom of the digester 33 to extract cooler wash liquor that is drawn counter-currently from the bottom of the digester. The lower part of vessel 33 may include a counter-current heated wash zone (referred to as a HI-HEAT™ wash zone in conventional Kamyr digesters), or a counter-current cooking zone, for example an Ahlstrom Kamyr EMCC® cooking zone in which some cooking chemical is added to the wash liquor to flow counter-currently therewith. The extracted filtrate in conduit 50 will be lower in sulfide concentration due to dilution by the wash filtrate. The filtrate from conduit 50 can be used to pretreat the chips entering the digester by recirculating it the transfer liquor return loop 35 by means of conduit 52. Recirculation via conduit 52 permits control of the effective alkali concentration and liquor-to-wood ratio during the cook. The relatively clean filtrate in conduit 52—which may be supplemented by wash filtrate—also can be used to displace dissolved solids to effect Ahlstrom Kamyr's LO-SOLIDS™ cooking (e.g. see WO 94/25668). Since the liquor in conduit 50 may contain fiber, a fiber filter or screen 51 may be used to remove fiber and return it to the pulp stream via conduit 53.

The weak black liquor in conduit 50 and the strong black liquor in conduit 45 may also be used to implement the two-step liquor impregnation process disclosed in co-pending applications Ser. No. 08/299,103 filed on Sep. 2, 1994 (10-1004); Ser. No. 08/345,822 filed on Nov. 21, 1994 (10-1024); and Ser. No. 08/403,932 filed Mar. 14, 1995 (10-1044). For example, the weak black liquor in conduit 50 may be introduced to circulation 16 or 22 as an initial treatment of chips, and the strong black liquor in conduit 45 may be introduced to circulation 22 or 28 as a second treatment. This sequence may also be reversed such that the strong black liquor treatment precedes the weaker black liquor treatment.

In the system shown in FIG. 1 the long counter-current cooking zones are limited to the pretreatment zones instead of at the end of the cook. Since the wood chip (or other comminuted cellulosic fibrous material) mass is softer at the end of the cook it is more difficult to pass liquor counter-currently through it. By limiting the size of the counter-current zone at the end of the cook the digester will be easier to operate. Conversely, the firmer chip mass of a pretreatment zone permits the passage of counter-current liquor easier and is thus more easy to operate. This aspect of this invention is particularly significant when it is applied to older, over-loaded digesters which have limited or no counter-current flow at the end of their cook.

Figure 2:
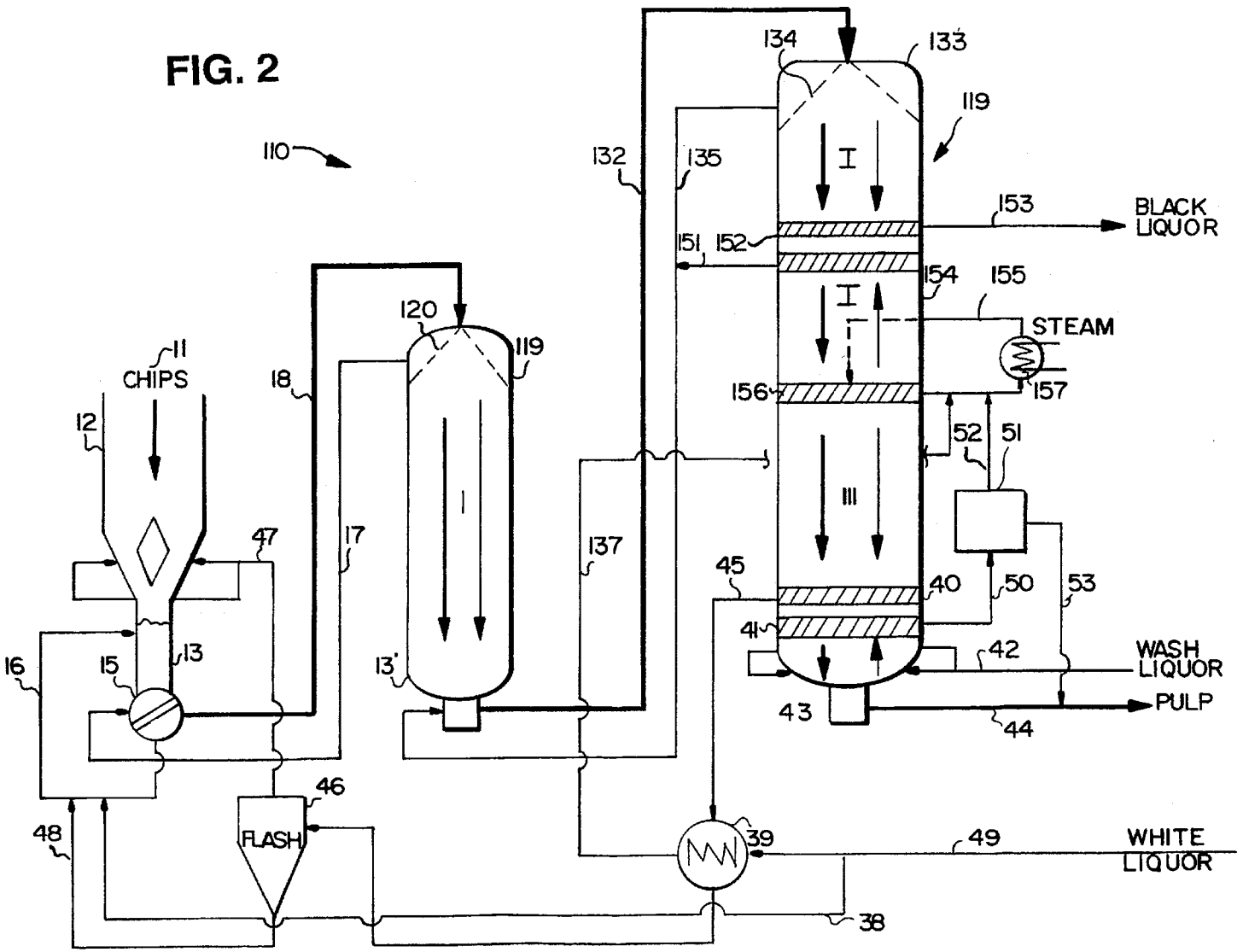
FIG. 2 is a schematic representation of a second embodiment of equipment (preexisting two vessel digester system) for practicing a method for producing enhanced intrinsic fiber strength chemical pulp according to the present invention

FIG. 2 illustrates the implementation of the processes illustrated in FIG. 1 into an existing two-vessel digester system. Components in FIG. 2 which are identical or have the same function as those in FIG. 1 are identified with the same numbers. Components in FIG. 2 which are unique though similar to those in FIG. 1 are prefaced by the numeral "1".

FIG. 2 illustrates a pulping system 110 with an identical feeding system as is shown in FIG. 1. (Note that the feed system shown includes the novel DIAMONDBACK steaming vessel, this system may also include a conventional feed system including a conventional chip bin and steaming vessel.) After presteaming in vessel 12, the cellulose material is treated with cooking liquor in a long, cool impregnation or pretreatment stage. This treatment, in zone I, is typically at between 80° and 110° C., preferably between 95° and 105° C., for one-half to six hours, preferably, one-three hours. This treatment is done in a first cooking vessel or impregnation vessel, 119, in a co-current treatment mode. This existing vessel typically does not contain any liquor circulations or screens, though it may have circulations and screens. For example, the vessel 119 may include one or more extraction screens creating zones of co-current and counter-current treatment.

After pretreatment, the impregnated material, at approximately 100° C., is slurried from the conventional outlet 131 of vessel 119 through conduit 132 to the top of a second cooking vessel, or digester, 133. Excess liquor is recovered from the slurry via screens 134 and is returned via conduit 135 to the vessel outlet 131 as the source of slurrying liquid. The liquor in conduit 135 may be supplemented by extracted liquor removed from other parts of the cook, for example, via conduit 151. Therefore the slurry entering the top of digester 133 typically has a temperature of between 110° and 120° C., typically about 115° C.

The pretreatment stage continues in co-current zone I of the digester 133 until the slurry reaches one or more screens 152 and 154. Pretreatment liquor, that is weak black liquor, may be drawn off via screens 152 and directed to recovery via conduit 153. Stronger black liquor drawn up from the counter-current cooking zone, zone II, may be drawn off via screen 151 and added to the recirculation conduit 135 via conduit 151.

The high alkali treatment characteristic of this invention is effected in the counter-current cooking zone II of digester 133. Most of the white liquor, typically at least 50%, preferably at least about 80% (e.g. about 90%) is added to the slurry via circulation 155. This produces a very high effective alkali concentration in the digester of greater than twenty five grams per liter, preferably greater than thirty five grams per liter. The circulation 155 includes one or more screens 156 and a indirect steam heater 157. The cooking liquor, typically kraft white liquor, is added to circulation 155 via conduit 137, and may be preheated in heat exchanger 39 with hot liquor extracted from elsewhere in the digester 119. The heated circulation 155 typically heats the slurry with cooking liquor to cooking temperature, typically 140°–180° C., preferably, 150°–170° C., prior to entering the co-current cooking zone, zone III (which may also include a counter-current cooking zone). The circulation 155 may also include an extraction and the introduction of liquid having lower dissolved organic material to effect Ahlstrom Kamyr's LO-SOLIDS™ cooking.

The cooking process proceeds in zone III until one or more screens 40 and 41 are encountered. Identical to the processes that were described with respect to FIG. 1, at these screens, the cooking process is terminated and the waste liquors of different chemical make-up are used for pretreatment, chemical recovery and heat recovery.

Though not shown the wash liquor in conduit 42 may also be directed to anywhere in the digester where it can be used to lower the concentration of dissolved material during cooking, for example, to circulations 17, 135 or 155.

Figure 3:
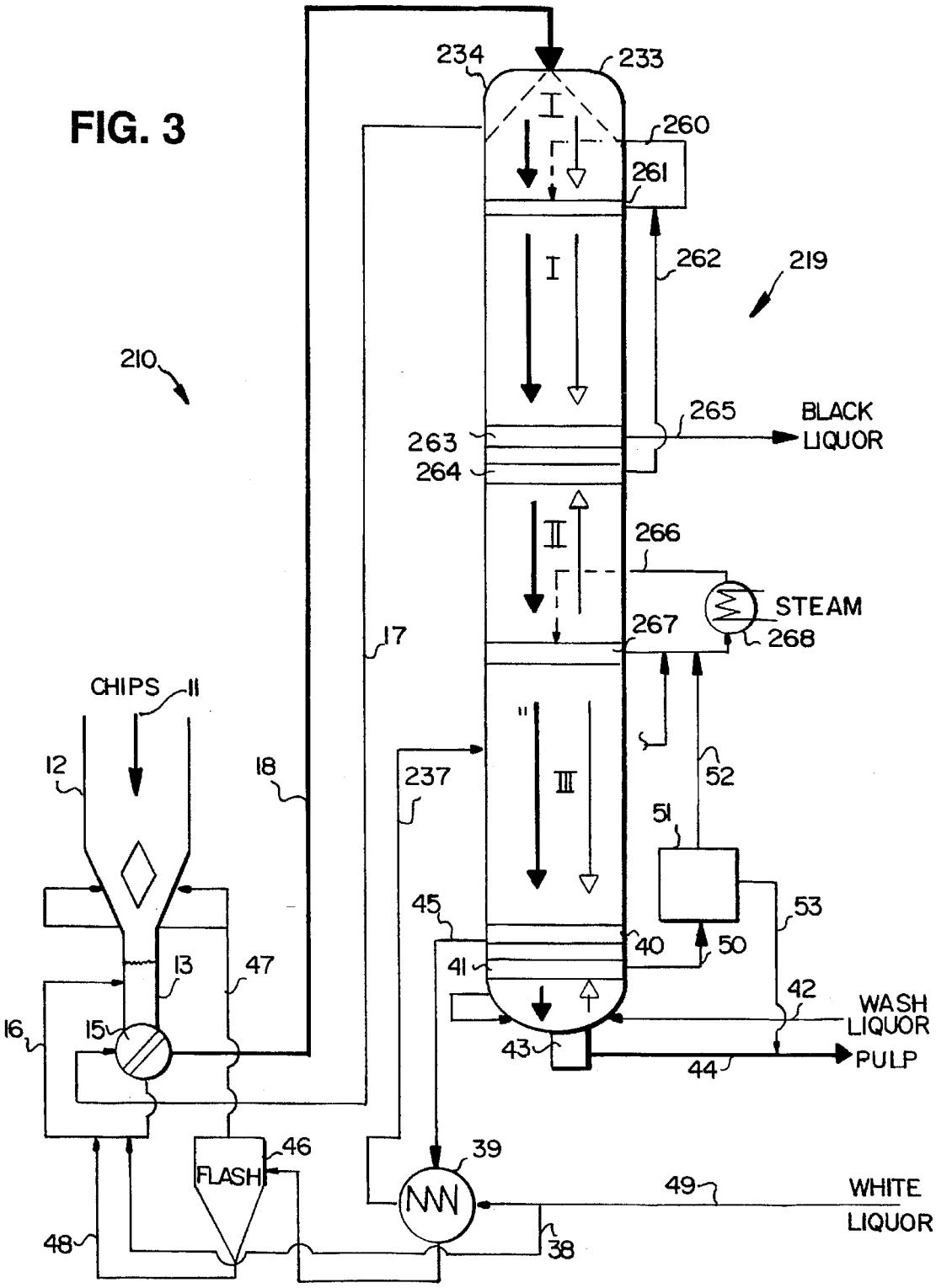
FIG. 3 is a schematic representation of a third embodiment of equipment (existing single vessel digester system) for practicing a method for producing enhanced intrinsic fiber strength chemical pulp according to the present invention

FIG. 3 illustrates the implementation of the processes practiced utilizing the apparatus illustrated in FIG. 1 into an existing single-vessel digester system. Components in FIG. 3 which are identical or have the same function as those in FIGS. 1 and 2 are identified with the same numbers. Components in FIG. 3 which are unique though similar to those in FIGS. 1 and 2 are prefaced by the numeral "2".

FIG. 3 illustrates a single-vessel pulping system 210 with an identical feeding system as is shown in FIGS. 1 and 2. (Again, note that the feed system shown includes the novel DIAMONDBACK steaming vessel, this system may also include a conventional feed system including a conventional chip bin and steaming vessel.) After presteaming in vessel 12, cooking liquors introduced to the cellulose material and the material is treated in a long, cool impregnation or pretreatment stage. This treatment, identified as zone I, begins in the chute 13 and continues in the transfer conduit 18 and in the upper part 233 of the digester 219. This treatment is typically at between 80° and 110° C., preferably between 95° and 105° C., for about five minutes to six hours, preferably about one-half to three hours. This treatment can typically be performed in a co-current fashion but it may also be a counter-current treatment. Excess liquor is removed from the slurry at the top of the vessel through screen 234 and is recirculated via conduit 17 back to the high-pressure feeder 15 to act as the transfer medium.

The pretreatment zone I may include a liquor circulation 260. Circulation 260 may include one or more screens 261 and a heat exchanger (not shown). The liquor in 260 may be supplemented by adding liquor extracted from other areas in the digester, e.g. via conduit 262. As a result the temperature of the slurry in the pretreatment zone below screen 261 may increase to 110°–120° C., typically to about 115° C.

The pretreatment is effectively terminated at one or more screens 263 and 264 which are located below screen 261. The upper screen, 263, may be used to extract pretreatment liquor form the slurry. This liquor in conduit 265 is typically low in useful treatment chemicals, such as alkali and sulfide, and is typically sent to the recovery system. As before, the liquor in line 265 may also be used to generated steam either by flashing or via an indirect heat exchanger. The liquor removed from the lower screen, 264, typically contains a significant amount of alkali and sulfide and can be recirculated to circulation 260 to pretreat the incoming material.

A counter-current cooking zone, zone II, is located below screen 264. Again, this zone may also be co-current. As is characteristic of the present invention a high concentration of effective alkali is introduced to this cooking zone II via conduit 237. As before, most of the white liquor, typically at least 50%, preferably at least about 80% (e.g. about 90%), is added to the slurry via circulation 266. Again, this produces a very high effective alkali concentration in this cooking zone of greater than twenty five grams per liter, preferably greater than thirty five grams per liter. The circulation 266 includes one or more screens 267 and an indirect steam heater 268. The cooking liquor, typically kraft white liquor, is added to circulation 266 via conduit 237, and may be preheated in heat exchanger 39 with hot liquor extracted from elsewhere in the digester 219. Heated circulation 266 typically heats the slurry with cooking liquor to cooking temperature, typically 140°–180° C., preferably, 150°–170° C., prior to entering the co-current cooking zone, zone III. Again, the cooking time may last from 5 minutes to six hours, but typically only lasts about one-half to three hours; and LO-SOLIDS™ extraction and dilution may also be provided associated with circulation 266.

As before, the cooking process proceeds in zone III until screens 40 and 41 are encountered. Identical to the processes that were described with respect to FIGS. 1 and 2, at screens 40 and 41 the cooking process is terminated and the waste liquors of different chemical make-up are used for pretreatment, chemical recovery and heat recovery. The wash liquor may be directed as described with respect to the FIG. 2 embodiment.

Figure 4:
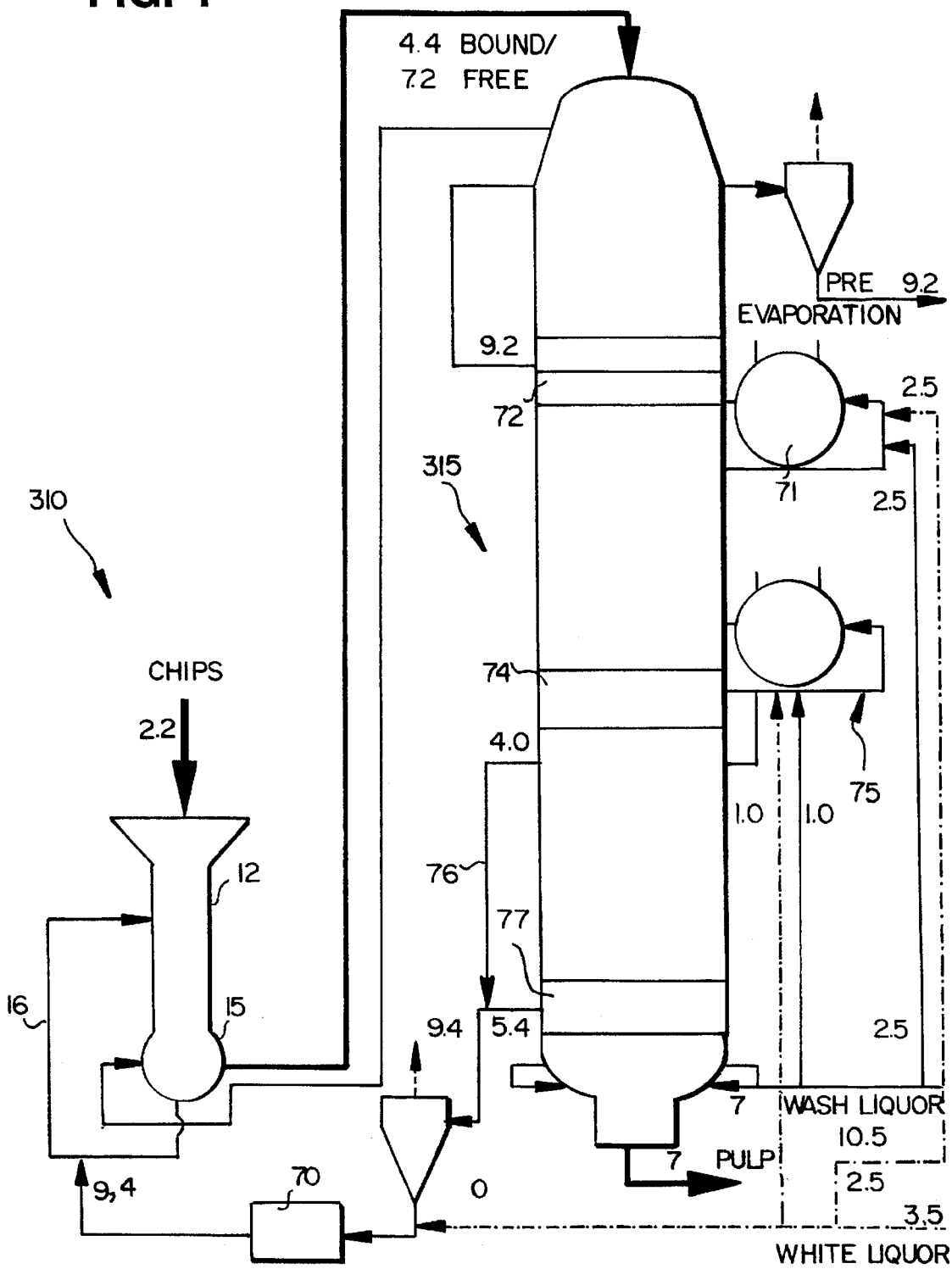
FIG. 4 is a schematic representation of another embodiment of equipment for practicing a method for producing enhanced intrinsic fiber strength chemical pulp according to the present invention.

FIG. 4 is a schematic illustration of another exemplary system that may be utilized according to the present invention. FIG. 4 includes typical bound and free liquor flow volumes (in $m^3$/BDMT) and free liquor flow direction, and illustrates a single vessel hydraulic digester system 310 similar to the system 210 in FIG. 3 (in FIG. 4 components similar to those of the other FIGURES shown by the same two digit reference number preceded by a "3"), for effective high alkali/high pH cooking according to the present invention. In FIG. 4 the numbers are total liquor flow in $m^3$/BDMT; what part of each flow is "bound" or "free" will be described herein. "Bound" liquor is the liquor entrained in the cellulose material, while "free" liquor is the liquor that is not bound but is allowed to pass in and around the cellulose material.

The vessel 12 and feed 15 system in FIG. 4 are the same as those in the other FIGURES, however FIG. 4 utilizes a white liquor cooler 70 which is not used in the other embodiments. The cooler 70 reduces the temperature of the white liquor (which, although shown as "0" in FIG. 4, may be present) and other liquors, such as black liquor entering the feed system, e.g. in line 16. In the example of FIG. 4 about 9.4 $m^3$/BDMT liquor enters the feed system at conduit 16, while 2.2 $m^3$/BDMT enters with the chips, providing a total flow of about 11.6 $m^3$/BDMT. Of this 11.6 $m^3$/BDMT fed to the top of the digester 319, about 4.4 $m^3$/BDMT is bound, and about 7.2 $m^3$/BDMT free. Impregnation continues until liquor is extracted via screen 365. Of the 9.2 $m^3$/BDMT removed via screen 365 about 7.2 $m^3$/BDMT is impregnation liquor while the other about 2.0 $m^3$/BDMT is liquor drawn upwardly from the counter-current section of digester 319 below screen 365. The 4.4 $m^3$/BDMT that is bound when it enters the top of digester 319 continues to be bound throughout passage through the digester 319.

After moving past screen 365, the cellulose material slurry is heated, white liquor is added, and solids displaced in the circulation 71 associated with screen 72. Of the 2.5 $m^3$/BDMT white liquor and 2.5 $m^3$/BDMT wash liquor added to circulation 71, about 2.0 $m^3$/BDMT flows counter-currently and is extracted, and about 3.0 $m^3$/BDMT continues with the cellulose material moving downwardly in digester 319.

The cellulose material in the slurry continues to cook with high alkali and low dissolved solids until screen 74 connected to circulation 75. Black liquor containing high residual alkali and sulfides is extracted in line 76 from circulation 75 (about 4.0 $m^3$/BDMT) and is directed to the feed system. Some of the extracted liquor is replaced by about 1.0 $m^3$/BDMT each of white liquor and wash filtrate. The material continues to be cooked below screen 74 in a counter-current cooking zone, though with less free liquor than before.

The cook is terminated at screen 77 where about 5.4 $m^3$/BDMT of spent liquor is extracted and combined with the extraction from line 76 and directed to the feed system, the liquor (black liquor) being cooled in heat exchanger 70. Cool wash liquor (about 7.0 $m^3$/BDMT) is added to the bottom of the digester 319 and passes counter-currently to the pulp to terminate the cook, cool the pulp, and wash the pulp prior to discharge. Of the about 7.0 $m^3$/BDMT added, about 4.4 $m^3$/BDMT passes upwardly and is extracted via screen 77, while about 2.6 $m^3$/BDMT exits the digester 319 with the approximately 4.4 $m^3$/BDMT bound liquor to produce the approximately 7.0 $m^3$/BDMT of liquor discharged with the pulp as illustrated in FIG. 4.

Figure 5:
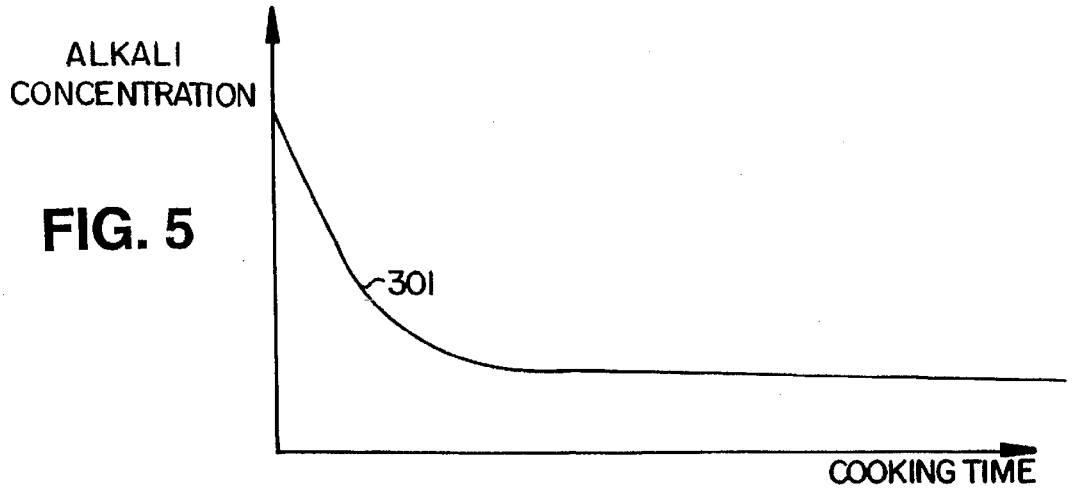
FIG. 5 is a plot of alkali concentration vs cooking time in a conventional cook.
Figure 6:
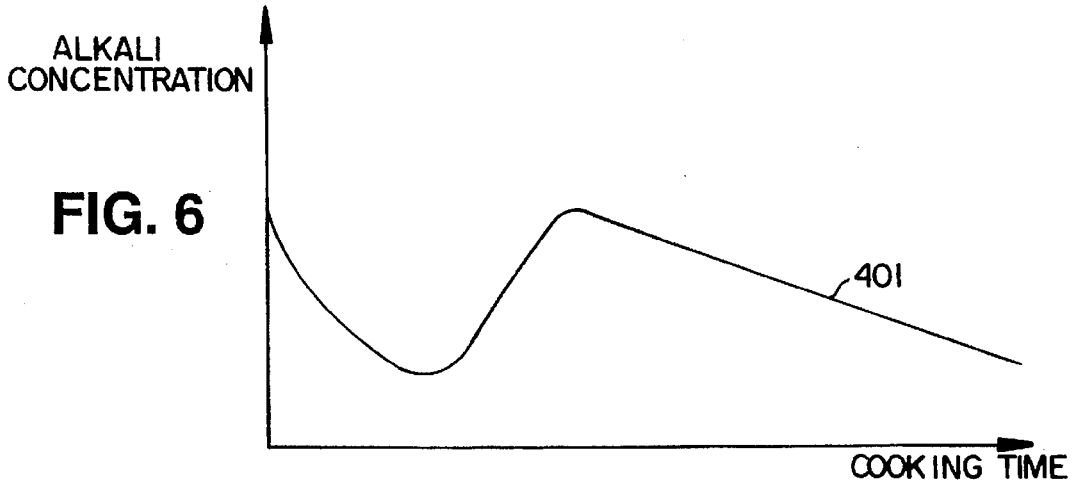
FIG. 6 is a plot of alkali concentration vs cooking time in a modified cook.
Figure 7:
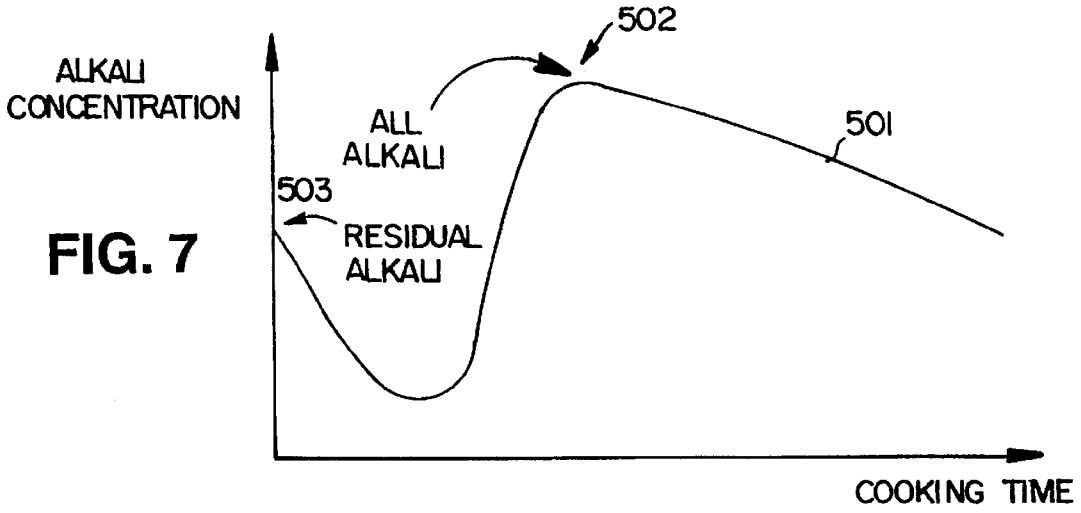
FIG. 7 is a plot of alkali concentration vs cooking time when practicing an exemplary method according to the present invention.

FIGS. 5–7 illustrate typical alkali concentration variations or profiles throughout a kraft cook for different cooking modes as a function of cooking time. FIG. 5 illustrates the alkali profile for a conventional kraft cook in which all the alkali is added to the feed system prior to impregnation. Curve 301 illustrates how the alkali is greatest at the beginning and decrease continually throughout the cook and achieving a minimum alkali concentration at the end of the cook.

FIG. 6 illustrates a typical alkali profile for a representative modified cook in which about half of the alkali is added at the beginning of the cook and about half is added at the end of impregnation. As shown by curve 401 the alkali concentration peaks at each addition of alkali, but this peak is less than the peak shown in FIG. 5.

FIG. 7 illustrates a typical alkali profile for a kraft cook according to the present invention. All, or substantially all, of the alkali is added after impregnation, at point 502, and the residual alkali present in the liquor after cooking is recirculated to the pretreatment at the start of the cook, point 503. As shown by curve 501, the residual alkali recirculation cause a moderate peak in alkali at the beginning of the cook, point 503, but a higher peak occurs at the point where all the alkali is added, point 502. According to the present invention it has been found that an alkali profile as shown in FIG. 7 produces chemical pulp having higher intrinsic fiber strength and better bleachability than pulp produced by the modified or conventional cooking methods of FIGS. 5 and 6.

FIGS. 8 and 9 graphically illustrate test data which shows the effect of residual alkali and high pH (i.e. preferably about 13.4 or above, typically about 13.6 or above) at the end of laboratory cooks. FIG. 8 shows how the tear index (an indication of intrinsic fiber strength) increases as the concentration of residual alkali increases at the end of the cook (the alkali is expressed as grams per liter of NaOH in FIG. 8), tear indices at seventy (curve 801) and ninety (curve 802) tensile strength being shown. FIG. 9 shows a similar trend of tear index value plotted versus residual pH using the same liquor used in FIG. 8, curve 901 at seventy tensile, and curve 902 at ninety tensile. FIGS. 8 and 9 thus clearly illustrate that intrinsic fiber strength of pulp increases as the residual alkali and/or residual pH increases.

Note that the pH and alkali concentrations shown in FIGS. 8 and 9 are those present in laboratory batch cooks. Actual in-mill conditions, such as the presence of dissolved salts and other materials in the liquor, will usually reduce both the pH and residual alkali actually measured in the mills to values lower than those shown.

It will thus be seen that the high alkali pulping process disclosed in this application can be readily integrated into several existing systems to provide novel processes for producing a chemical cellulose pulp that is stronger than pulps produced by the conventional art. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to cover all equivalent processes, products, and systems.

What is claimed is:

1. A method of producing chemical pulp having enhanced intrinsic fiber strength from comminuted cellulosic fibrous material, comprising the steps of continuously and sequentially:

(a) treating the comminuted cellulosic fibrous material with a first cooking liquor having a first effective alkali concentration which is greater than 10 g/l;

(b) further treating the material with the first cooking liquor so as to consume alkali from the first cooking liquor, so that the effective alkali concentration of the spent first liquor is reduced to about 10 g/l or less;

(c) extracting the spent first cooking liquor from the material;

(d) treating the material with a second cooking liquor having a second effective alkali concentration greater than about 25 g/l and greater than the first concentration, the second cooking liquor providing at least 50% of the total alkali to be consumed by the material in the production of chemical pulp;

(e) cooking the material with the second cooking liquor at cooking temperature to produce chemical pulp and a spent second cooking liquor having an effective alkali concentration of greater than about 15 g/l; and (f) extracting the spent second cooking liquor from the pulp.

2. A method as recited in claim 1 wherein step (b) is practiced using as the first cooking liquor spent second cooking liquor from step (f).

3. A method as recited in claim 2 wherein step (b) is further practiced using some added white liquor, in addition to spent cooking liquor from step (f), as the first cooking liquor.

4. A method as recited in claim 1 wherein more than about 25% of the total alkali to be consumed in the production of the pulp is consumed during the practice of step (b).

5. A method as recited in claim 1 wherein about 50% of the total alkali to be consumed in the production of the pulp is consumed during the practice of step (b).

6. A method as recited in claim 1 wherein the second cooking liquor comprises white liquor combined with wash liquor or black liquor.

7. A method as recited in claim 6 wherein about 80% or more of the total amount of white liquor and total alkali to be used to produce the pulp is added in step (d) as the second cooking liquor.

8. A method as recited in claim 1 wherein the practice of step (d) results in simultaneous heating of the material to a cooking temperature in the range of 140°–180° C.

9. A method as recited in claim 8 wherein the cooking temperature is between 150° and 170° C.

10. A method as recited in claim 1 wherein at least steps (d) and (e) are practiced in a continuous digester; and wherein the liquor present in the digester as the second cooking liquor has an effective alkali concentration of greater than about 25 g/l.

11. A method as recited in claim 10 wherein the concentration of effective alkali desired is achieved by diluting white liquor having an effective alkali concentration of 90 g/l or more with dilution liquor.

12. A method as recited in claim 1 wherein at least steps (d) and (e) are practiced in a continuous digester; and wherein the liquor present in the digester as the second cooking liquor has an effective alkali concentration of about 25–60 g/l and a volume of about 2.0–5.0 $m^3$/BDMT.

13. A method as recited in claim 1 wherein the liquor present in the digester as the second cooking liquor has an effective alkali concentration of about 30–50 g/l and a volume of about 3.0–4.0 $m^3$/BDMT.

14. A method as recited in claim 1 comprising the subsequent step, after step (f), of cooling and washing the pulp, and comprising the further step, before step (a), of steaming the material to heat it and remove air from it.

15. A method as recited in claim 1 wherein steps (d), (e), and (f) are repeated at least one more time each.

16. A method as recited in claim 1 wherein the spent liquors extracted in steps (c) and (f) are kept separately, and used for different purposes.

17. A method as recited in claim 16 wherein the liquor from step (f) is used to preheat the second cooking liquor, and then flashed, with the remaining liquor used as the first cooking liquor while the flashed steam is fed to a chips bin or presteaming vessel for pretreatment of the material; and wherein the liquor from step (c) is passed to conventional recovery in a kraft mill.

18. A method as recited in claim 1 wherein steps (a), (b), (d) and (e) are practiced co-currently or counter-currently, and wherein step (e) is practiced so that the effective residual alkali concentration is greater than about 20 g/l.

19. A kraft pulp with enhanced intrinsic fiber strength and bleachability compared to kraft pulp produced by conventional and modified cooking, said pulp produced by the steps of continuously and sequentially: (a) treating comminuted cellulosic fibrous material with a first cooking liquor having a first effective alkali concentration which is greater than 10 g/l; (b) further treating the material with the first cooking liquor so as to consume alkali from the first cooking liquor, so that the effective alkali concentration of the spent first liquor is reduced to about 10 g/l or less; (c) extracting the spent first cooking liquor from the material; (d) treating the material with a second cooking liquor having a second effective alkali concentration greater than 25 g/l and greater than the first concentration, the second cooking liquor providing at least 50% of the total alkali to be consumed by the material in the production of chemical pulp; (e) cooking the material with the second cooking liquor at cooking temperature to produce chemical pulp and a spent second cooking liquor having an effective residual alkali concentration of greater than about 15 g/l; and (f) extracting the spent second cooking liquor from the pulp.

* * * * *